US005603401A

United States Patent [19]

Brunner

[11] Patent Number: 5,603,401

[45] Date of Patent: Feb. 18, 1997

[54] STORAGE APPARATUS

[76] Inventor: Martin C. Brunner, 704 E. Pearl, Batesville, Ind. 47006

[21] Appl. No.: 537,130

[22] Filed: Sep. 29, 1995

[51] Int. Cl.[6] ..... B65D 85/00

[52] U.S. Cl. ..... 206/204; 206/6.1; 220/484

[58] Field of Search ..... 220/400, 402, 220/403, 408, 410, 484; 206/204, 215, 305, 317, 6.1, 524.6, 524.3, 524.1

[56] References Cited

U.S. PATENT DOCUMENTS

| | | | |
|---|---|---|---|
| D. 338,317 | 8/1993 | Woodward . | |
| 2,610,443 | 9/1952 | Carlson . | |
| 3,505,006 | 4/1970 | White . | |
| 3,672,103 | 6/1972 | Kost . | |
| 3,837,521 | 9/1974 | Huston et al. . | |
| 4,158,102 | 6/1979 | Bright | 220/484 X |
| 4,359,845 | 11/1982 | Harrison . | |
| 4,394,144 | 7/1983 | Aoki . | |
| 4,665,668 | 5/1987 | Serpico . | |
| 4,813,791 | 3/1989 | Cullen et al. . | |
| 4,834,234 | 5/1989 | Sacherer et al. . | |
| 5,029,699 | 7/1991 | Insley et al. | 206/204 |
| 5,160,021 | 11/1992 | Sibley et al . . | |

*Primary Examiner*—Jacob K. Ackun
*Attorney, Agent, or Firm*—Barnes & Thornburg

[57] ABSTRACT

A storage apparatus includes a container having an interior region for storing items, a first closed end, and a second open end. The apparatus also includes a slide liner located within the interior region of the container, and a shield having a lower closed end and an upper open end. The shield is positioned inside the slide liner to permit withdrawal of the shield once items are loaded into the shield. The apparatus further includes a desiccant material configured to be positioned inside the shield surrounding the items, and a removable end cap for closing the second open end of the container.

20 Claims, 3 Drawing Sheets

FIG. 4
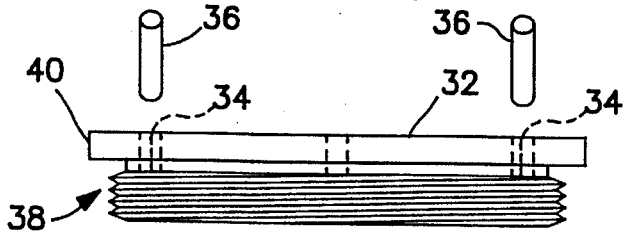
FIG. 5
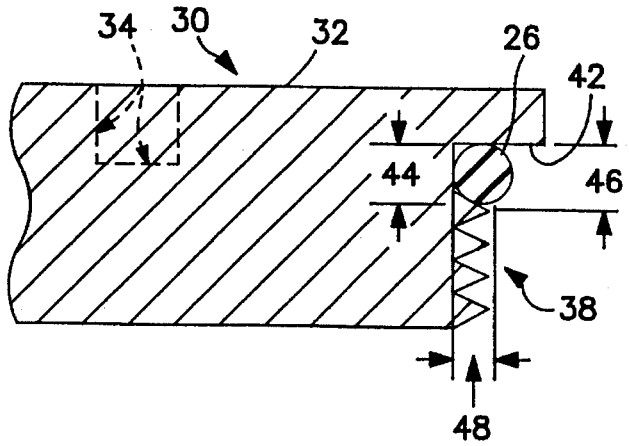
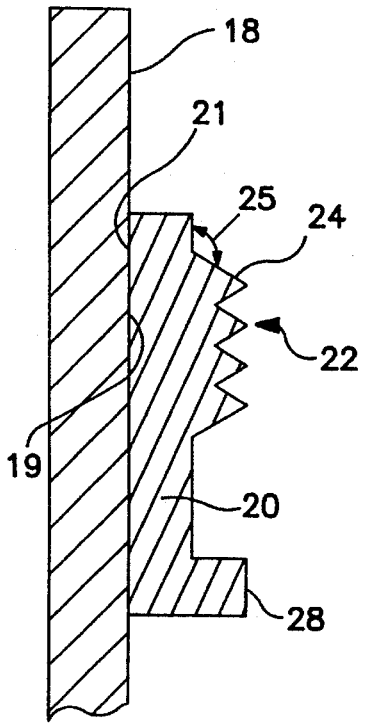
FIG. 6
FIG. 7
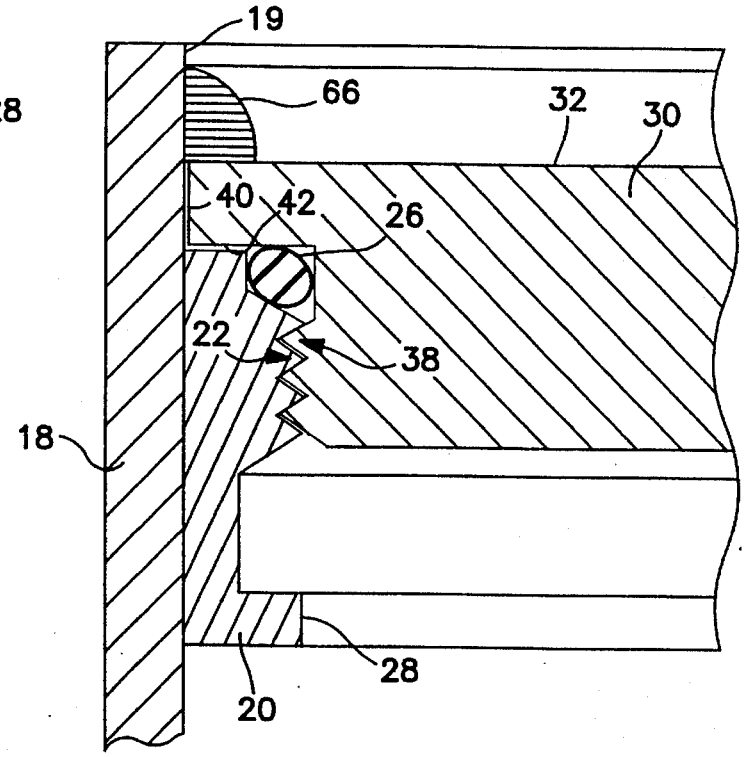

STORAGE APPARATUS

BACKGROUND AND SUMMARY OF THE INVENTION

The present invention relates to an improved storage apparatus for storing items. More particularly, the present invention relates to an improved container or storage apparatus for below and above ground storage of items which prevents or substantially reduces deterioration of the stored items due to outside influences.

The present invention relates to a storage apparatus that preserves in secret, usually underground, private valuables, firearms, survival equipment, and papers, at an affordable price. The storage apparatus comprises a container body with one closed end. An opposite open end of the container body has a removable and sealable cap formed with threads to open and re-close the open end. The open end is sealed with an O-ring seal located between machined sealing surfaces and also by an industrial silicone seal applied from a tube around the removable cap on and end sealing surface. The storage apparatus also includes a slide liner to aid in extraction of stored objects, an acid shield which minimizes contamination of stored objects from ground and water born acids, and a desiccant filler material to surround stored objects, absorb moisture, and displace air from an interior region of the container.

Stored objects are preferably first placed in acid proof, non-sealed storage bags for further corrosion protection. The removable threaded end cap has a unique spanner wrench arrangement of four holes and two hardwood pegs to make removal of the cap possible without additional special tools. The threaded end cap and container end are further covered with a protective plastic watershed or overcap to prevent dirt and water contamination from collecting over the removable end cap.

The invention is preferably made entirely of non-metallic substances, synthetic resins, polyethylene, poly vinyl chloride, PET-G, natural clays, ethylene, propylene, and ethylene-propylene.

The storage of one's valuables in a secret place for indefinite periods of time has long been sought. This must be achieved without appreciable deterioration of the items stored, and at an economical cost to the user. Many containers made of materials such as cast iron and clay have been used in various designs over the last several hundred years without much success. Today people want to hide valuables where only they know their location. This usually means burying them. In burying valuables, storage containers are almost never successful except in extremely dry climates.

The present invention provides an apparatus for affordable long term underground storage of valuables. The present invention uses only non-metallic, non-corrosive materials of the highest quality, by shielding the stored objects from the corrosive acids and elements found in the soil, and by removing the air in the container. If the air inside an interior region of the container is displaced by a natural moisture absorbing material, and the acids are kept from leaching through the storage container, successful underground storage of items is possible. Also, in order to make sure that no condensation occurs, it is necessary to place the device in a constant temperature environment, usually below the frost line.

The present invention provides secure storage of one's valuables by the use of synthetic resins of various types in its construction, especially polyvinyl chloride in the body and ends of the outer casing of the container, PET-G in the slide liner, polyethylene to keep out acids, especially hydrochloric acid, in the corrosive acid shield, an ethylene propylene compound in the O-ring seal, polyethylene in the storage bags, natural oven dried clay as desiccant, and Loctite 77BR a silicone end seal for redundancy. Additionally, the design and the machining of the end cap and upper coupling makes the O-ring seal virtually leak proof. The solvent welding of the polyvinyl chloride components make virtually a one piece structure.

According to an aspect of the invention, a storage apparatus includes a container having an interior region for storing items, a first closed end, and a second open end. The apparatus also includes a slide liner located within the interior region of the container, and a shield having a lower closed end and an upper open end. The shield is positioned inside the slide liner to permit withdrawal of the shield once items are loaded into the shield. The apparatus further includes a desiccant material configured to be positioned inside the shield surrounding the items, and a removable end cap for closing the second open end of the container.

In the illustrated embodiment, the second open end of the container is formed to include an internal threaded portion for engaging threads formed on the removable end cap to secure the end cap to the container. The apparatus includes an O-ring seal located between the threaded portion of the container and the threads on the removable end cap. The removable end cap includes a bottom lip portion. The O-ring seal is located between the bottom lip of the removable cap and the threads. The O-ring has a volume which is larger than a volume defined between the bottom lip an threads of the removable cap and the threaded portion of the container when the end cap is threaded into the threaded portion of the container so that the O-ring is compressed by and provides a seal between the container and the removable end cap. The apparatus also includes a silicone seal located between a top surface of the removable end cap and an inner side wall of the container.

The removable cap is formed to include at least two apertures for receiving pegs therein to facilitate removal of the cap from the threaded portion of the container. The apparatus still further includes a thread protector formed on the container between the first closed end and the threaded portion to protect the threaded portion as items are removed from the interior region. The illustrated apparatus includes an overcap positioned over the second open end of the container and over the removable end cap to protect the second open end of the container and the removable end cap.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which:

FIG. 4 illustrates details of a removable end cap and a hole arrangement for receiving pegs to remove the cap;

FIG. 5 is an enlarged sectional view of the end cap of FIG. 4 illustrating the configuration of threads, an O-ring cap seat area, and an o-ring seal;

FIG. 6 is an enlarged view illustrating details of a an upper section of the main tube body upper, a threaded coupling ring for threaded engagement with the end cap to seal the storage apparatus, and a thread protection flange; and FIG. 7 illustrates details of the installed end cap sealed by the O-ring and an additional silicone seal placement.

DETAILED DESCRIPTION OF DRAWINGS

Figure 1:
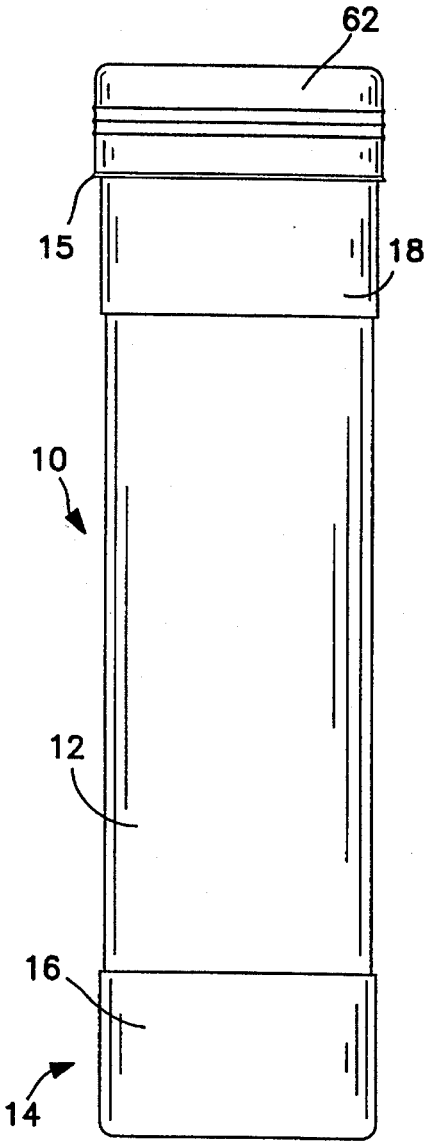
FIG. 1 is a side elevational view of the storage apparatus of the present invention.
Figure 3:
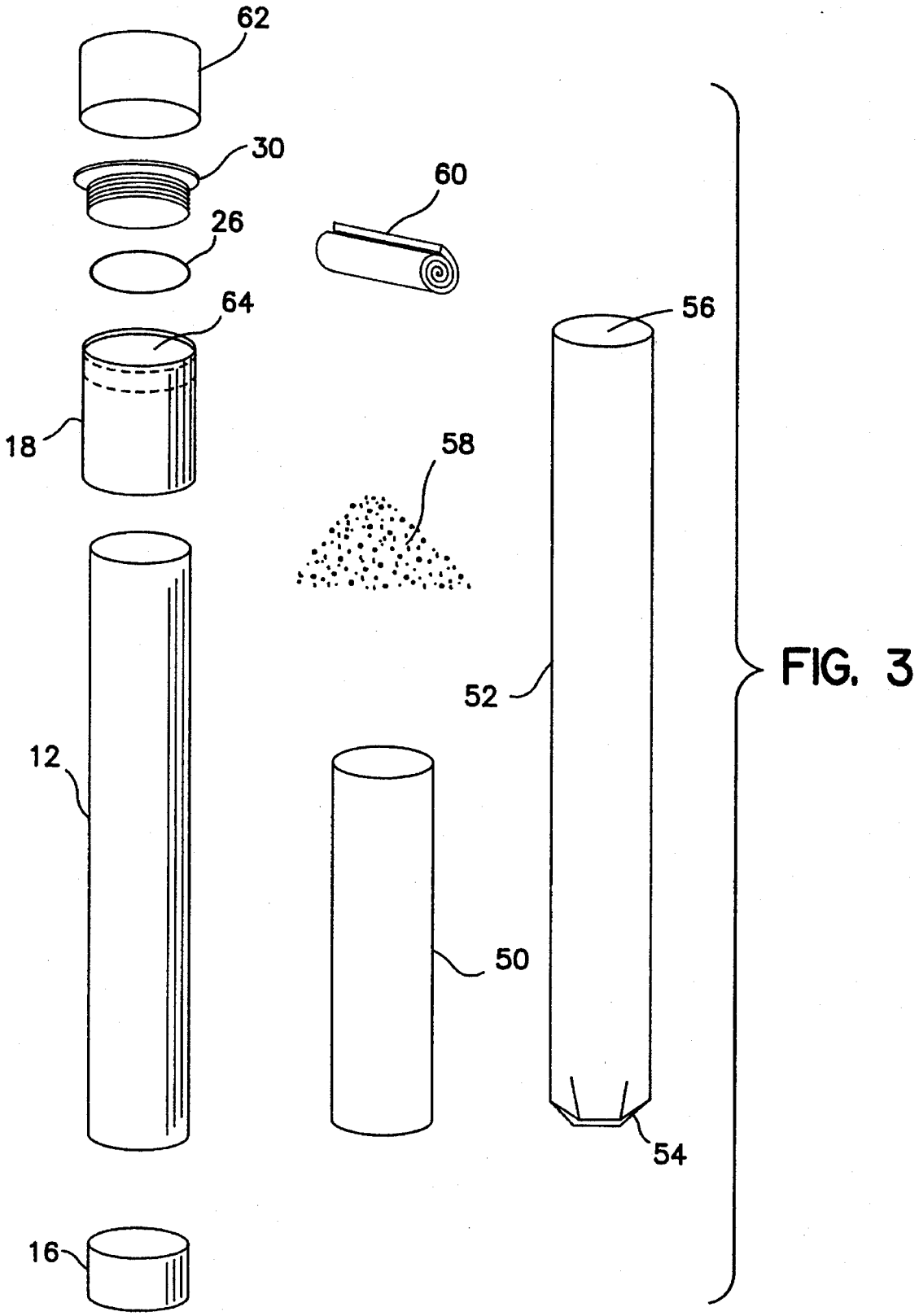
FIG. 3 is an exploded perspective view of the storage apparatus of FIGS. 1 and 2.

Referring now to the drawings, the storage apparatus 10 of the present invention is illustrated in FIG. 1, and as an exploded view in FIG. 3. The apparatus 10 includes a cylindrically shaped main tube body 12. The tube body 12 is closed on its lower end 14 by a lower end cap 16. Illustratively, the end cap 16 is a molded end cap and is solvent welded to the cylindrical tube body 12.

Figure 2:
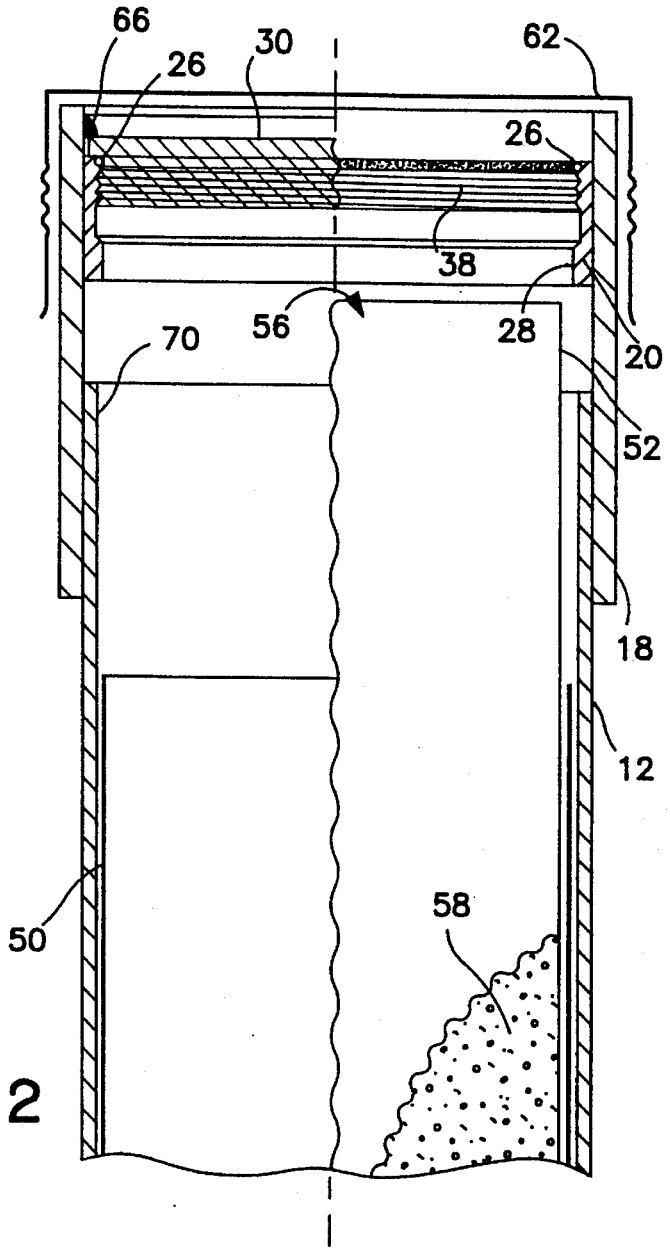
FIG. 2 is a partial sectional view taken through the storage apparatus of FIG. 1.

An upper tube section 18 is illustratively a molded cylindrical tube. A coupling ring 20 is a piece of material having an outer side wall 21 similar in dimension to a dimension of an inner side wall 19 of upper tube section 18. The outer side wall 21 of coupling ring 20 is solvent welded to the inner side wall 19 of upper tube section 18. The subassembly of upper tube section 18 and coupling ring 20 is then machined as illustrated in FIG. 6. Specifically, coupling ring 20 is machine to include threads 22 having a top angled surface 24 aligned at an angle 25 which engages an O-ring seal 26. Illustratively, angle 25 is about 30°. Coupling ring 20 also includes a thread protector extension 28. Thread protector 28 extends radially inwardly at the same distance as the crowns of the threads 22 to protect the threads 22 as articles are removed from the container. The finished subassembly of upper tube section 18 and coupling ring 20 is then solvent welded to the main tube body 12 as illustrated in FIG. 2. Therefore, the main tube 12, lower end cap 16 and upper tube section 18 provide substantially a one piece container.

A removable cap 30 is made from a heavy resin sheet, and is machined to correspond to drawings shown in FIG. 4 and FIG. 5. The removable cap 30 includes a top surface 32 formed to include spaced apart holes or notches 34 for the receiving pegs 36 therein. Notches 34 extend only partly into cap 30. Illustratively, four spaced apart holes 34 are provided. Two pegs 36 are used to facilitate removal of the cap as discussed below. Preferably, the holes 34 are equally spaced, radially inwardly about 2 inches from an edge 40 of cap 30. Cap 30 also includes a threaded section 38 configured to engage threads 22 of coupling ring 20.

As illustrated in FIG. 5, a first thread 38 is spaced apart from a bottom lip 42 of cap 30 by a distance illustrated by dimension 44. Illustratively, dimension 44 is about 0.187 inch. The first crown of threads 38 is spaced apart from bottom lip 42 by a distance illustrated by dimension 46. Distance 46 illustratively about 0.225 inch. The height of threads 38 is illustrated by dimension 48. Illustratively dimension 48 is about 0.100 inch. Threads 38 are spaced at about eight threads per inch. An O-ring 26 is located between bottom lip 42 of cap 30 and the first thread 38. The O-ring 26 has a volume which is larger than a volume defined between the bottom lip 42 and threads 38 of the removable cap 30 and the threaded portion 22 of the tube body when the end cap 30 is threaded into the threaded portion 22 of the tube body so that the O-ring 26 is compressed by and provides a seal between the tube body and the removable end cap 30.

Main tube body 12, lower end cap 16, upper tube section 18, coupling ring 20, and cap 30 are made of synthetic resins, preferably virgin polyvinyl chloride, but at a minimum, schedule 40 commercial grade materials. The O-ring 26 is preferably made of an ethylene propylene compound and provides the primary seal between cap 30 and the main tube body 12.

A slide liner 50 illustrated in FIGS. 2 and 3 is inserted into an open upper end 64 of the apparatus 10 and positioned in a lower section 14 of the tube body 12 adjacent lower end cap 16. Slide liner 50 is preferably made of a synthetic resin, commercially known as PET-G. Slide liner 50 is illustratively a hollow cylindrical tube fabricated from thin sheet stock to an outside diameter slightly smaller than an inside diameter of side wall 70 of the main tube body 12. This enables the slide liner 50 to slide up and down inside the main tube body 12. Illustratively, the slide liner 50 is about ⅛ inch to about 1/16 inch smaller than the inner diameter and main tube 12.

A corrosive acids shield 52 is preferably made of heavy gauge polyethylene film tubing and is constructed with a lower end 54 which is closed and sealed by thermal means. A top end 56 of the shield 52 is left open for loading items. Polyethylene was selected for shield 52 because it substantially blocks acids found in the soil, especially compounds or mixtures containing hydrochloric acid. Illustratively, shield 52 has a thickness of about 8/1000 inch.

FIG. 2 and FIG. 3 illustrate a desiccant 58 used to absorb any moisture that might be present in the tube 12 after it is sealed and buried. The material for desiccant 58 is preferably an oven baked clay, but it is understood that other desiccant materials can be used in accordance with the present invention. The desiccant 58 is placed inside shield 52 after the items are loaded as discussed below.

Polyethylene bags 60 illustrated in FIG. 3 having various sizes are first used to cover the objects that are to be stored. These bags 60 keep the objects clean, and provide an additional barrier against corrosives that cause deterioration. Illustratively, bags 60 have a thickness of about 2/1000 inch.

A watershed overcap 62 illustrated in FIGS. 1—3 is preferably made of a molded polyethylene material. The watershed overcap 62 fits loosely over the entire upper end 15 of the storage apparatus 10. The purpose of the watershed overcap 62 is to keep the threaded end cap 30 of the invention free of dirt and to cause water or liquids to pass over the end of the main tube body 12 without contacting the machined end cap 30.

The invention is used as follows. The products to be stored are first placed in the plastic bags 60, and open ends of the bags 60 wrapped or rolled closed like a paper bag. The bags 60 are not sealed. This prevents air and moisture from becoming trapped in bags 60. The main tube 12 is positioned vertically with lower end cap 16 at the bottom. The slide liner 50 is inserted into the open end 64 of the main tube body 12 and slides to the lower end 14 of the main tube 12. The acid shield 52 is then installed into the main tube body 12 through opening 64. Shield 52 is located inside the slide liner 50 as illustrated in FIG. 2 with the closed end 54 against the end cap 16. A small amount of desiccant 58 is placed in the bottom of the acid shield 52 after it is installed and before any items are placed in the shield 52. The products to be stored are then placed in the acid shield 52. These items are then surrounded and covered by additional and remaining desiccant 58 loaded into shield 52. The open upper end 56 of the acid shield 52 is also wrapped closed like a paper bag. Open end 56 of shield 52 is not sealed to prevent air from being trapped in the shield 52. The threaded cap 30, with O-ring 26 installed thereon is then screwed into place as best illustrated in FIG. 7.

An industrial silicone product 66 is placed around the top surface 32 of cap 30 to further prevent any foreign materials from entering the interior region of the apparatus. As shown in FIG. 7, the silicone seal 66 extends around the outer edge 40 of cap 30 to provide a seal between top surface 32 and inner side wall 19 of upper tube section 18. Illustratively, silicone seal 66 is a Loctite 77BR silicone material. The watershed overcap 62 is then placed over the upper end 15 of the storage apparatus 10. The apparatus 10 is now ready to be hidden or buried.

To remove items from the apparatus 10, a knife is used to peel the silicone seal 66 away. Two pegs 36 are inserted in two opposite holes 34 in end cap 30 as shown in FIG. 4, and the end cap 30 is removed by rotating the cap 30. The acid shield 52 is then pulled upwardly out of the body tube 12. The slide liner 50 is necessary because any appreciable weight in the bottom of the acid shield 52 will make the acid shield 52 expand against the inner wall 70 of the tube 12. The acid shield 52 is made of an elastic material, while the slide liner 50 is non-elastic and prohibits acid shield 52 expansion. Therefore, the slide liner 50 compensates for the elasticity of the shield 52 and permits removal of the shield 52 and the stored items from the apparatus. Thread protector 28 protects threads 22 during removal of the items.

With the acid shield 52 and its contents removed, the stored items can be retrieved. The apparatus 10, once buried, does not need to be removed from the ground to load or unload items. The apparatus may be buried and uncovered so that only about the top six inches of the apparatus is exposed, usually in a hole several feet below ground level. Then the stored items can be removed while the apparatus is still partially buried.

Although the invention has been described in detail with reference to a certain preferred embodiment, variations and modifications exist within the scope and spirit of the present invention as described and defined in the following claims.

What is claimed is:

1. A storage apparatus comprising:

a container having an interior region for storing items, a first closed end, and a second open end;

a slide liner located within the interior region of the container;

a shield having a lower closed end and an upper open end, the shield being positioned inside the slide liner to permit withdrawal of the shield once items are loaded into the shield;

a desiccant material configured to be positioned inside the shield surrounding the items; and a removable end cap for closing the second open end of the container.

2. The apparatus of claim 1, wherein the second open end of the container is formed to include an internal threaded portion for engaging threads formed on the removable end cap to secure the end cap to the container.

3. The apparatus of claim 2, further comprising an O-ring seal located between the threaded portion of the container and the threads on the removable end cap.

4. The apparatus of claim 3, further comprising a silicone seal located between a top surface of the removable end cap and an inner side wall of the container.

5. The apparatus of claim 2, wherein the removable cap is formed to include at least two apertures for receiving pegs therein to facilitate removal of the cap from the threaded portion of the container.

6. The apparatus of claim 2, further comprising a thread protector formed on the container between the first closed end and the threaded portion to protect the threaded portion as items are removed from the interior region.

7. The apparatus of claim 1, further comprising an overcap positioned over the second open end of the container and over the removable end cap to protect the second open end of the container and the removable end cap.

8. The apparatus of claim 1, wherein the container and the removable end cap are made from at least a schedule 40 commercial grade plastic material.

9. The apparatus of claim 1, wherein the slide liner is made from a synthetic resin material.

10. The apparatus of claim 1, wherein the shield is made from a polyethylene film.

11. The apparatus of claim 1, wherein the desiccant is an oven baked clay.

12. The apparatus of claim 1, wherein the removable end cap includes a bottom lip portion, a plurality of threads for engaging a threaded portion formed adjacent the second open end of the container, and an O-ring seal located between the bottom lip of the removable cap and the threads, the O-ring having a volume which is larger than a volume defined between the bottom lip an threads of the removable cap and the threaded portion of the container when the end cap is threaded into the threaded portion of the container so that the O-ring is compressed by and provides a seal between the container and the removable end cap.

13. A storage apparatus comprising:

a tube body having a cylindrical shape defining an interior region for storing items, the tube body having a first open end and a second open end, the second open end of the tube body being formed to include a threaded portion;

a lower end cap coupled to the first end of the tube body;

a slide liner located within the interior region of the tube body;

a shield having a lower closed end and an upper open end, the shield being positioned inside the slide liner to permit withdrawal of the shield once items are loaded into the shield;

a desiccant material configured to be positioned inside the shield surrounding the items;

a removable end cap for closing the second open end of the tube body, the removable end cap having threads configured to engage the threaded portion of the tube body to secure the end cap to the tube body and close the second open end of the tube body;

an O-ring seal located between the threaded portion of the tube body and the threads on the removable end cap;

a silicone seal located between a top surface of the removable end cap and an inner side wall of the tube body; and an overcap positioned over the second open end of the tube body and over the removable end cap to protect the open end of the tube body and the removable end cap.

14. The apparatus of claim 13, wherein the removable cap is formed to include at least two apertures for receiving pegs therein to facilitate removal of the cap from the threaded portion of the tube body.

15. The apparatus of claim 13, further comprising a thread protector formed on the tube body below the threaded portion to protect the threaded portion as items are removed from the interior region.

16. The apparatus of claim 13, wherein the removable end cap includes a bottom lip portion and the O-ring seal is located between the bottom lip of the removable cap and the threads, the O-ring having a volume which is larger than a volume defined between the bottom lip and threads of the removable cap and the threaded portion of the tube body when the end cap is threaded into the threaded portion of the tube body so that the O-ring is compressed by and provides a seal between the tube body and the removable end cap.

17. A storage apparatus comprising:

a main tube body having a cylindrical shape defining an interior region for storing items, the main tube body having a first open end and a second open end;

a lower end cap coupled to the first end of the tube body to close the first end of the main tube body;

a cylindrical upper tube section coupled to the second open end of the tube body, the upper tube section being formed to include a threaded portion;

a removable end cap for closing the second open end of the main tube body, the removable end cap having threads configured to engage the threaded portion of the upper tube section to secure the end cap to the upper tube section and close the second open end of the tube body;

an O-ring seal located between the threaded portion of the upper tube section and the threads on the removable end cap; and a silicone seal located between a top surface of the removable end cap and an inner side wall of the upper tube section.

18. The apparatus of claim 17, further comprising a slide liner located within the interior region of the tube body, a shield having a lower closed end and an upper open end, the shield being positioned inside the slide liner to permit withdrawal of the shield once items are loaded into the shield, and a desiccant material configured to be positioned inside the shield surrounding the items.

19. The apparatus of claim 17, further comprising an overcap positioned over the second open end of the tube body and over the removable end cap to protect the open end of the tube body and the removable end cap.

20. The apparatus of claim 17, further comprising a ring coupled to an inner side wall of the upper tube section, the ring being formed to include the threaded portion.

* * * * *